US011260280B2

(12) United States Patent
Papadopoulos

(10) Patent No.: US 11,260,280 B2
(45) Date of Patent: Mar. 1, 2022

(54) BICYCLE TRAINER PERMITTING STEERING AND TILTING MOTION

(71) Applicant: Larry C. Papadopoulos, North Plains, OR (US)

(72) Inventor: Larry C. Papadopoulos, North Plains, OR (US)

( * ) Notice: Subject to any disclaimer, the term of this patent is extended or adjusted under 35 U.S.C. 154(b) by 0 days.

(21) Appl. No.: 16/723,571

(22) Filed: Dec. 20, 2019

(65) Prior Publication Data

US 2020/0122011 A1 Apr. 23, 2020

Related U.S. Application Data

(63) Continuation-in-part of application No. 16/121,957, filed on Sep. 5, 2018, now Pat. No. 10,933,291, which is a continuation-in-part of application No. PCT/US2017/045730, filed on Aug. 7, 2017.

(60) Provisional application No. 62/371,658, filed on Aug. 5, 2016.

(51) Int. Cl.
*A63B 69/16* (2006.01)

(52) U.S. Cl.
CPC ..... *A63B 69/16* (2013.01); *A63B 2069/162* (2013.01); *A63B 2069/165* (2013.01)

(58) Field of Classification Search
CPC ..... A63B 2069/161; A63B 2069/162; A63B 2069/163; A63B 2069/164; A63B 2069/165; A63B 2069/166; A63B 2069/167; A63B 2069/168; A63B 69/16
See application file for complete search history.

(56) References Cited

U.S. PATENT DOCUMENTS

| | | | |
|---|---|---|---|
| 3,659,844 | A | 5/1972 | Cummins |
| 4,817,939 | A | 4/1989 | Auspurger et al. |
| 4,925,183 | A | 5/1990 | Kim |
| 4,958,832 | A | 9/1990 | Kim |

(Continued)

FOREIGN PATENT DOCUMENTS

| | | |
|---|---|---|
| CN | 201880060229.0 | 2/2019 |
| FR | 2636587 A1 | 3/1990 |

(Continued)

OTHER PUBLICATIONS

Minoura Co., Ltd. 'Action Bridge'. Retrieved from the Internet: <URL: https://web.archive.org/web/20150524200628/http://www.minoura.jp/english/trainer-e/option-e/bridge-e.html> May 24, 2015.

(Continued)

*Primary Examiner* — Nyca T Nguyen
*Assistant Examiner* — Zachary T Moore
(74) *Attorney, Agent, or Firm* — Timothy E. Siegel Patent Law, PLLC; Timothy E. Siegel

(57) ABSTRACT

A bicycle trainer, including a base, permitting fore and aft movement and a frame, supported by the base. Also, a seat and a handlebar assembly and a pedaling assembly is supported by the frame. The handlebar assembly is rotatably engaged to the frame, and is supported by a tongue, that is hinged to the base so as to permit horizontal rotation, and the handlebar assembly is attached to the tongue at a position removed from the hinge. Turning the handlebars causes the frame to move laterally.

18 Claims, 12 Drawing Sheets

(56) References Cited

U.S. PATENT DOCUMENTS 5,035,418 A * 7/1991 Harabayashi ..... A63B 22/16 482/62
5,042,795 A * 8/1991 Bursik ..... A63B 69/16 482/61
5,050,865 A 9/1991 Augspurger
5,240,417 A 8/1993 Smithson
5,480,366 A * 1/1996 Hamden ..... A63B 69/16 482/57
6,126,577 A 10/2000 Chang
6,322,480 B1 11/2001 Lim
6,530,864 B1 * 3/2003 Parks ..... A63B 69/16 482/4
6,857,992 B1 2/2005 Kolda et al.
7,081,070 B1 7/2006 Washington
7,326,151 B2 2/2008 Peterson
7,438,672 B1 10/2008 Rylander
7,481,746 B2 * 1/2009 Ibarguren ..... A63B 22/0605 482/57
7,766,798 B2 8/2010 Hamilton
7,927,258 B2 * 4/2011 Irving ..... A63B 21/4034 482/57
8,092,352 B2 * 1/2012 Irving ..... A63B 23/0476 482/57
8,439,808 B2 5/2013 Hamilton
9,669,257 B2 6/2017 Irving
9,707,443 B2 7/2017 Warren
9,855,480 B2 1/2018 Kalogiros
10,071,298 B1 9/2018 McCormack
10,124,226 B2 11/2018 Kimura
10,265,580 B2 4/2019 Kalogiros
10,974,118 B2 4/2021 Bass et al.
2002/0055422 A1 5/2002 Airmet
2004/0053751 A1 3/2004 Pizolato
2005/0209064 A1 * 9/2005 Peterson ..... A63B 69/16 482/61
2006/0229163 A1 10/2006 Waters
2006/0234839 A1 * 10/2006 Peterson ..... A63B 69/16 482/61
2007/0142184 A1 6/2007 Schroeder
2008/0020908 A1 1/2008 Ibarguren
2008/0269025 A1 * 10/2008 Badarneh ..... A63B 21/4049 482/57
2009/0075785 A1 3/2009 Schroeder
2009/0186746 A1 7/2009 Pandolfo
2010/0062909 A1 3/2010 Hamilton
2010/0125029 A1 5/2010 Nielson
2010/0234188 A1 * 9/2010 Wan ..... A63B 21/15 482/61
2010/0288901 A1 11/2010 Wallach
2011/0218080 A1 9/2011 Papadopoulos
2011/0287901 A1 11/2011 Wan
2011/0287902 A1 * 11/2011 Bingham, Jr. ... A63B 21/00069 482/61
2012/0071301 A1 3/2012 Kaylor
2013/0130798 A1 3/2013 Nir
2015/0065309 A1 * 3/2015 Bauer ..... A63B 21/0058 482/61
2015/0217158 A1 8/2015 Colan
2015/0238808 A1 8/2015 Lin
2016/0067580 A1 3/2016 Viera
2016/0158620 A1 6/2016 Bauer
2016/0236036 A1 8/2016 Kalogiros
2016/0287931 A1 10/2016 Tung
2017/0072254 A1 3/2017 Ryu
2018/0369675 A1 12/2018 Papadopoulos

FOREIGN PATENT DOCUMENTS

KR 20120071425 7/2012
WO 2012146230 11/2012
WO 2018027216 A1 2/2018

OTHER PUBLICATIONS

ISR and Written Opinion of related international application PCT/US17/045730 issued by KIPO dated Nov. 17, 2017.

* cited by examiner

BICYCLE TRAINER PERMITTING STEERING AND TILTING MOTION

RELATED APPLICATIONS

This application is a continuation-in-part of U.S. patent application Ser. No. 16/121,957 filed Sep. 5, 2018 which itself is a continuation-in-part of international application PCT/US17/45730, filed Aug. 7, 2017, in the US Receiving Office, which claims priority from provisional application 62/371,658, filed Aug. 5, 2016, all of which are incorporated by reference is if fully set forth herein.

TECHNICAL FIELD

The present invention is in the field of bicycle trainers that accept a bicycle and wherein a user rides the bicycle on the bicycle trainer and can move the handlebars.

BACKGROUND ART

Although to the casual observer it might appear that a person bicycling along a straight road is progressing at an even speed and in a straight line, a closer examination reveals that this is not the case. Rather, there is a subtle side to side movement caused by a shifting of the rider's weight as he peddles. Although he may be unaware of this, the rider must counter this movement by maintaining a good grip on the handlebar, and resisting the tendency of the bicycle to turn, in response to this weight shifting. Also, the speed of the cyclist undergoes a subtle variation over the pedaling cycle.

Many exercise devices, such as stationary bikes, that attempt to mimic the feel of riding a bicycle provide an unsatisfactory feel for the rider, particularly if the rider is a frequent bicyclist. Part of the reason for this is the lack of sideways motion permitted by these devices, so that the rider does not move in the same way as he does on an actual bicycle ride.

SUMMARY

In a first separate aspect, the invention may take the form of a bicycle training assembly having a rear and a front and including an upper frame, having a rider seat mount, a handlebar mount, a pedals mount; a seat support extending from the seat mount to the pedals mount, and a joining bar, joining the handlebar mount to the rider seat mount; a pedals mount support extending from the pedals mount. Further, a handlebar unit, includes a handlebar that is supported by a post which is rotatably engaged to the handlebar mount, with a further handlebar support extending downwardly from the post. Also, a seat unit includes a seat supported by a seat post that is engaged to the seat mount and a pair of pedals is rotatably mounted in the pedals mount. Additionally, a base assembly includes a handlebar support holding strut and a pedal mount support bearing member. The bases assembly further includes a lower base subassembly adapted to rest on a flat upward surface and including a base unit set, supporting the handlebar support holding strut and a pedal mount support bearing member, and permitting fore and aft movement. Returning to the bicycle training assembly as a whole, it also includes a pedaling resistance assembly. Also, a tongue is hinged to the handlebar support holding strut, so as to permit substantially horizontal rotation of the tongue, and the handlebar support is supported by the tongue in a position displaced from the hinge. In addition, the pedals mount support bearing member is pivotably supported by the lower base sub-assembly. Finally, when the handlebar is turned to a side, the handlebar support translates as well as rotates and the upper frame, rotates about the point where the pedals mount support bearing member is pivotably supported by the lower base sub-assembly.

In a second separate aspect, the invention may take the form of a bicycle trainer, including a base, permitting fore and aft movement and a frame, supported by the base. Also, a seat and a handlebar assembly and a pedaling assembly is supported by the frame. The handlebar assembly is rotatably engaged to the frame, and is supported by a tongue, that is hinged to the base so as to permit horizontal rotation, and the handlebar assembly is attached to the tongue at a position removed from the hinge. Turning the handlebars causes the frame to move laterally.

In a third separate aspect, the invention may take the form of a bicycle trainer, having a rear and a front defining a longitudinal dimension and a transverse dimension, and including a base, adapted to rest on a flat upward surface and having two parallel feet extending substantially in the longitudinal dimension and set apart longitudinally. Also, a slider, that has a transverse portion, transversely spans the base and is slidably engaged to each foot, to permit fore and aft movement, and has a longitudinal section extending from the transverse center of the transverse portion, this section having a front and a back. Further, a base support beam is vertically hinged to the back of the longitudinal section. Additionally, an upper frame includes a rider seat mount, a handlebar mount, a pedals mount; a seat support extending from the seat mount to the pedals mount, and a joining bar, joining the handlebar mount to the rider seat mount with a pedals mount support extending from the pedals mount. A handlebar unit includes a handlebar supported by a post that is rotatably engaged to the handlebar mount, a further handlebar support extending downwardly from the post. A seat unit, including a seat supported by a seat post, is engaged to the seat mount and a pair of pedals rotatably mounted in the pedals mount. Also, a pedals support mount bearing member, supports the pedals mount support and is pivotably supported by the base support beam. Further, a handlebar support holding strut is supported by the front of the base support beam. A tongue is hinged to the handlebar support holding strut, so as to permit substantially horizontal rotation of the tongue, and the handlebar support is supported by the tongue in a position displaced from the hinge and when the handlebar is turned to a side, the handlebar support translates as well as rotates and the upper frame rotates about the point where the pedals mount support bearing member is pivotably supported by the lower base sub-assembly. Finally, a fluid pressure cylinder is mounted on the longitudinal section of the slider and attached to the base support beam, to raise the base support beam upwardly causing it to rotate vertically about the back of the longitudinal section, where it is hinged.

DETAILED DESCRIPTION OF THE PREFERRED EMBODIMENTS

Figure 1:
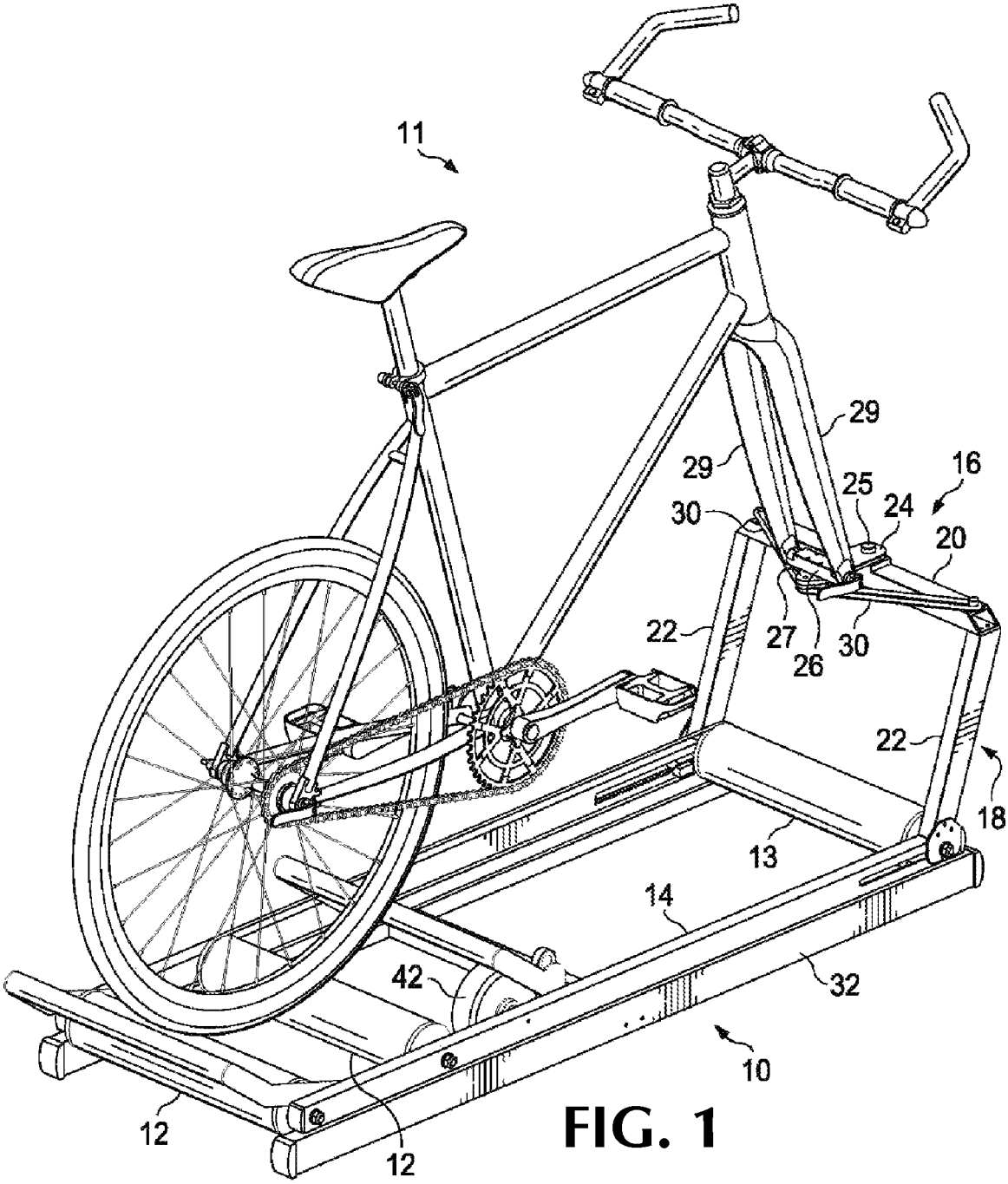
FIG. 1 is a top side rear isometric view of a bicycle rollers assembly, according to the present invention, hosting a bicycle, with the handlebars straight.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
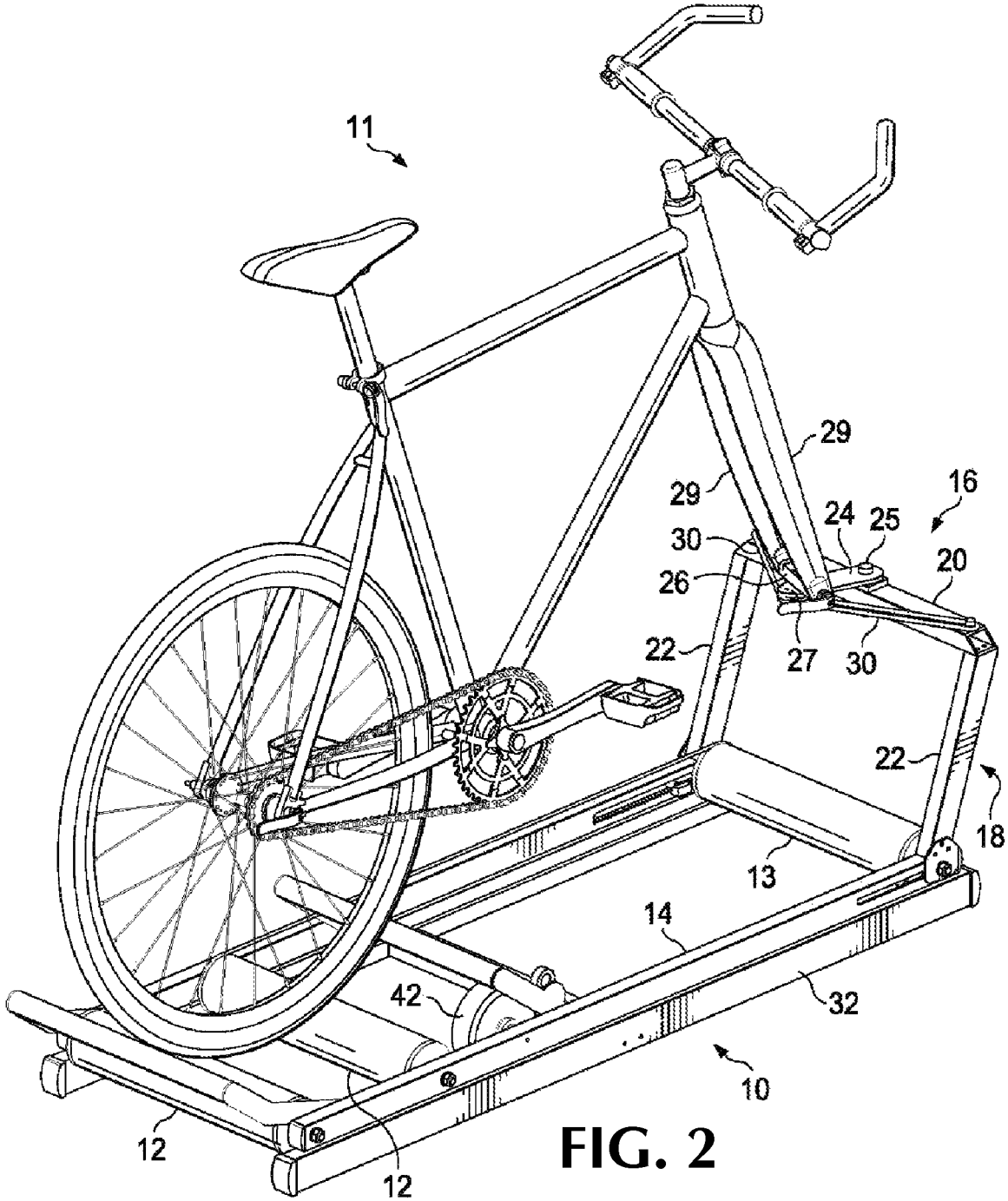
FIG. 2 is the same view as FIG. 1, but with the bicycle handlebars turned slightly to the right.
Figure 3:
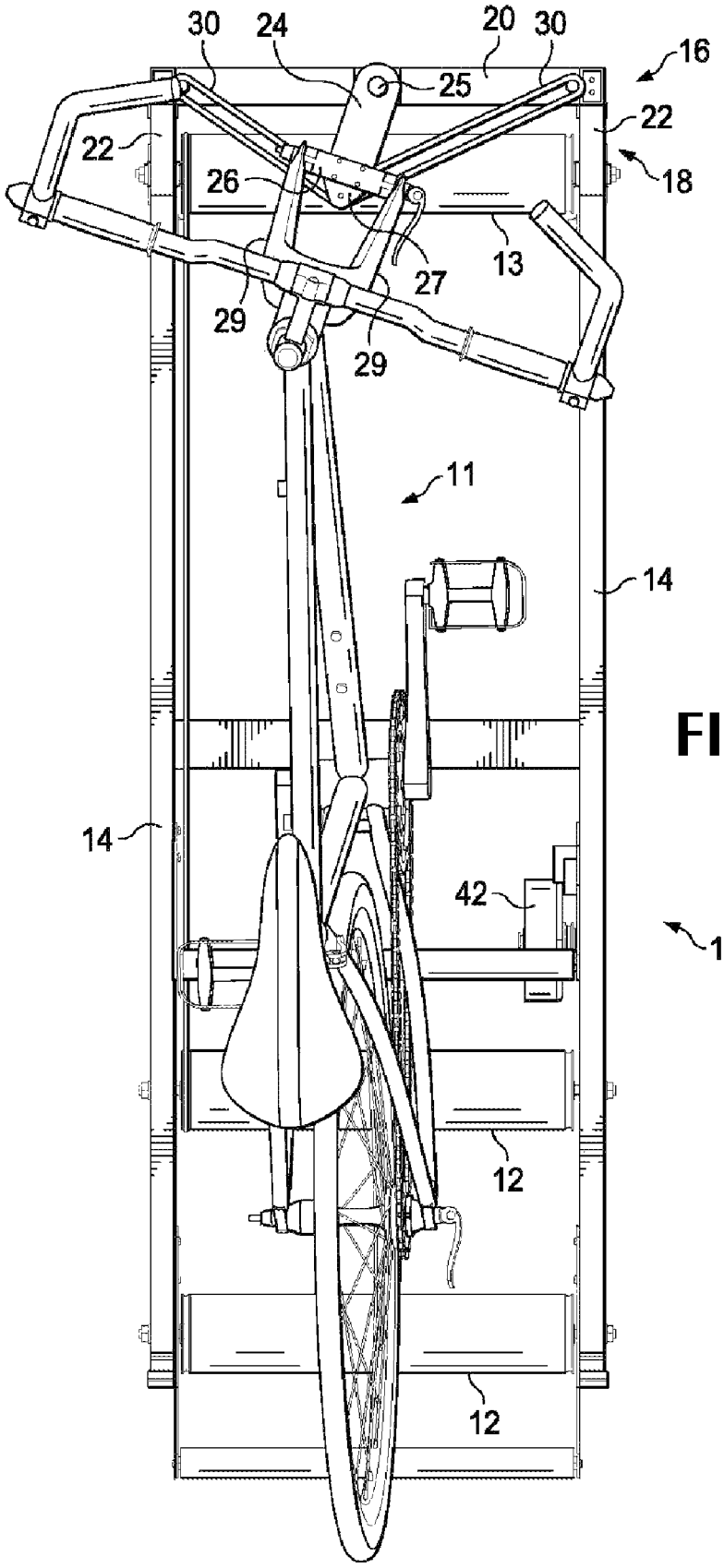
FIG. 3 is a top view of the assembly of FIG. 1.
Figure 4:
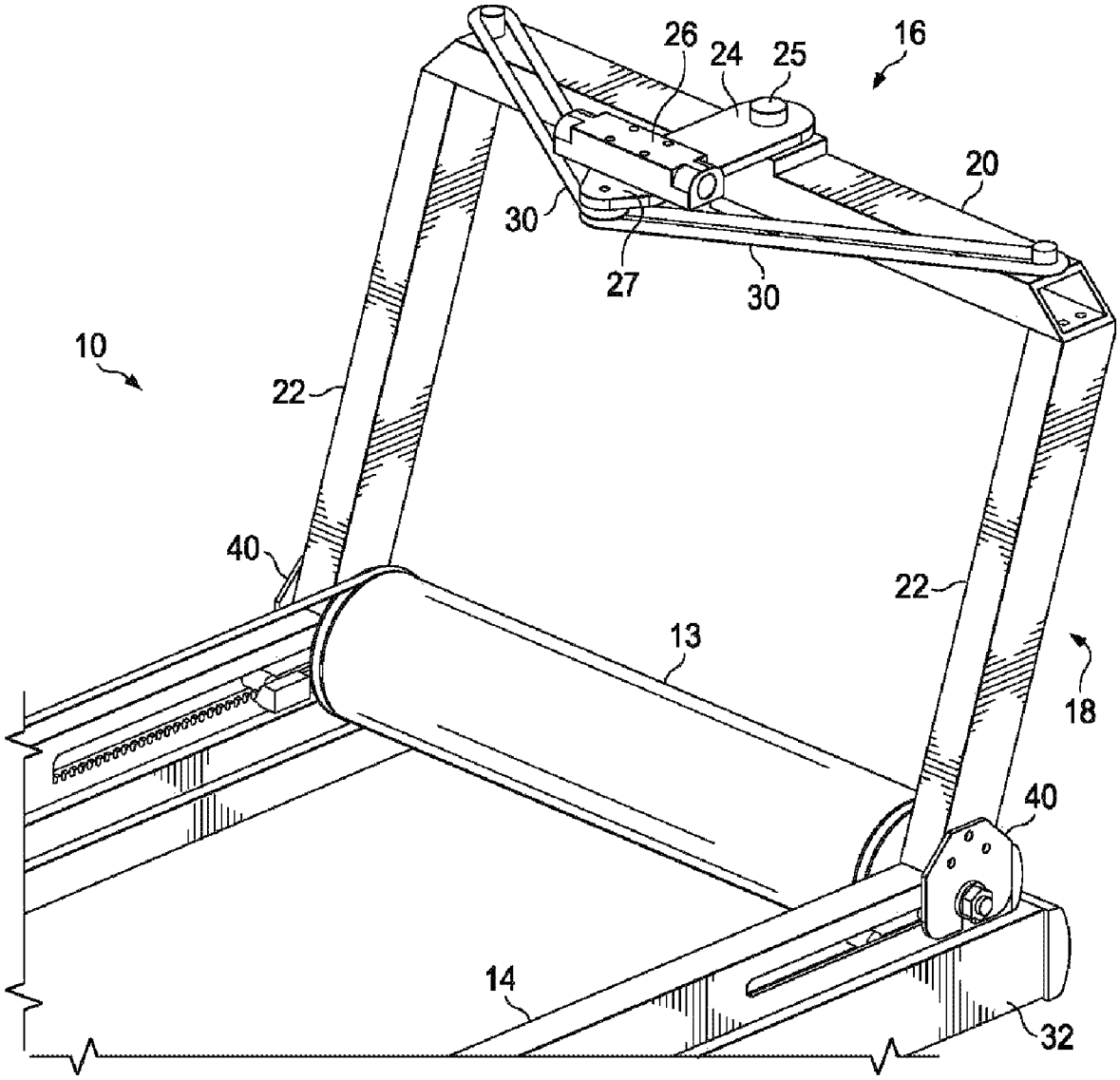
FIG. 4 is a top side rear view of the front of the assembly of FIG. 1, with no bicycle hosted on it.

Referring to FIGS. 1 and 4, a modified bicycle rollers assembly 10, shown hosting a bicycle 11 (in FIGS. 1-3), includes a rear pair of rollers 12, and a front roller 13, mounted on a frame 14 and a front bicycle fork supporting assembly 16, including a U-frame 18, having a center bar 20 and two side supports 22, which are attached to the front part of the frame 14. At the center of the center bar 20 is a front fork support 24 that is rotatably mounted at a pivot point 25. Support 24 includes a rear projection 27 that includes a support 26 for each of the arms 29 of a bicycle fork. A pair of springs, in the form of rubber bands, 30, one in either sideways direction, are each mounted between a post (not shown) extending downwardly from fork support 24 and a side support 22. These rubber bands 30 resist side-to-side turning, as shown in FIGS. 2 and 3.

As fork support 26 and the attached fork rotate off of center, the rotated bicycle fork generates an off-vertical tilt to the bicycle frame. Inversely, pedaling forces create a tilt to the bike frame that will result in a steering action. Thus, the rider is able to modulate tilt by controlling the steering. Additionally, the resistance of rubber bands 30 to the rotation of fork support 26 play a role in stabilizing the bicycle on assembly 10 and preventing excessive tilt, while also, to some degree, mimicking the resistance to steering encountered by friction between the bicycle wheel and the road surface.

This configuration may be originated by retrofitting an existing bicycle rollers assembly, by providing a front bicycle fork supporting assembly 16 that bolts onto the frame 14 at the location of the front roller 13. Stabilizing plates 40, a part of assembly 16, help to stabilize U-frame 18. In one preferred embodiment, frame 14 is an inner frame, which is set into an outer or bottom frame 32 in a manner that permits resisted movement between frame 14 and frame 32, to more effectively mimic the feel of actual bicycling.

Similar to other bicycle rollers assemblies, assembly 10 includes a subassembly 42 to provide resistance to the turning of the front rear roller, to provide a more realistic feel and different exertion levels. Frames 14 and 32 are made of aluminum and separated by wheels or rollers to permit movement of top frame 14. The motion is gently resisted by a bungee or other form of spring (not shown).

Figure 5:
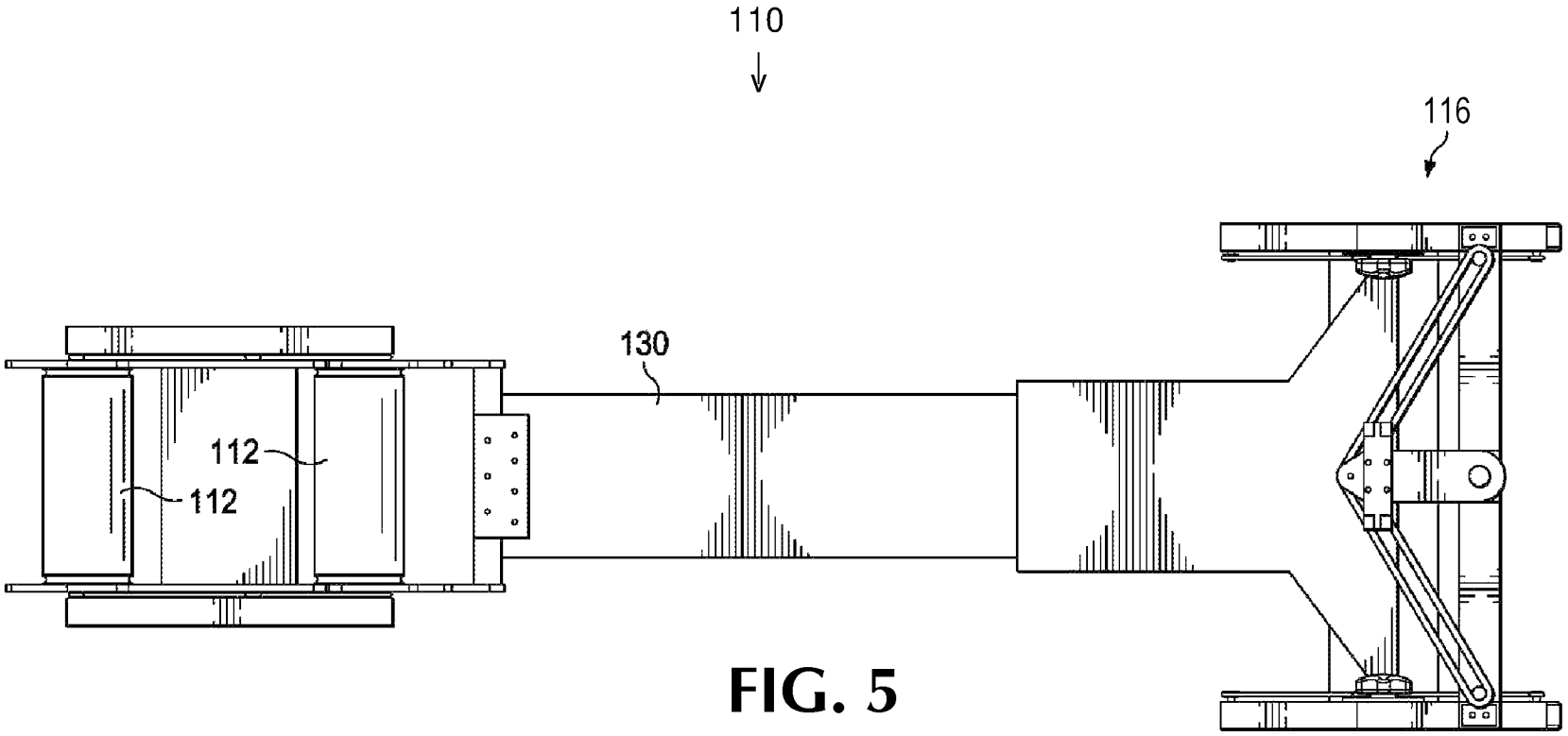
FIG. 5 is a top view of an alternative embodiment of a bicycle rollers assembly.

Referring to FIG. 5, in an alternative preferred embodiment, a bicycle rollers assembly 110, similar to assembly 10, may be especially purpose-built. In this assembly, there would typically not be a front roller 13 (FIG. 1), but only the front bicycle fork supporting assembly 116 at the front. Also, although in a conventional bicycle rollers assembly some width is needed to permit side-to-side wandering in the steering, when the front fork is bolted in place this width is no longer needed and the entire assembly can be made substantially narrower, with the width of the rear rollers 112 and the bridge 130 connecting front assembly 116 to rear rollers 112, being as little as 15 cm (6 in) or less. This embodiment permits a substantial savings in materials and in the weight of the full assembly, thereby permitting easier portability for a user.

Assemblies 10 and 110, each has a more realistic feel to the rider, as the natural side-to-side motion of the handlebars, imparted by pedaling, is resisted by the rider. Although the rider may be unaware that he is even making this effort as part of the exercise of riding a bicycle, he or she may notice a subtle difference between the bicycle riding experience and the experience of riding a bicycle mounted on a frame. The assembly may be made lighter and narrower, however, greatly facilitating transportability and easy storage. Similar to assembly 10, assembly 110 includes a rear roller resistance mechanism and can be set into an outer frame, so that it can move slightly forward and backward.

Figure 6:
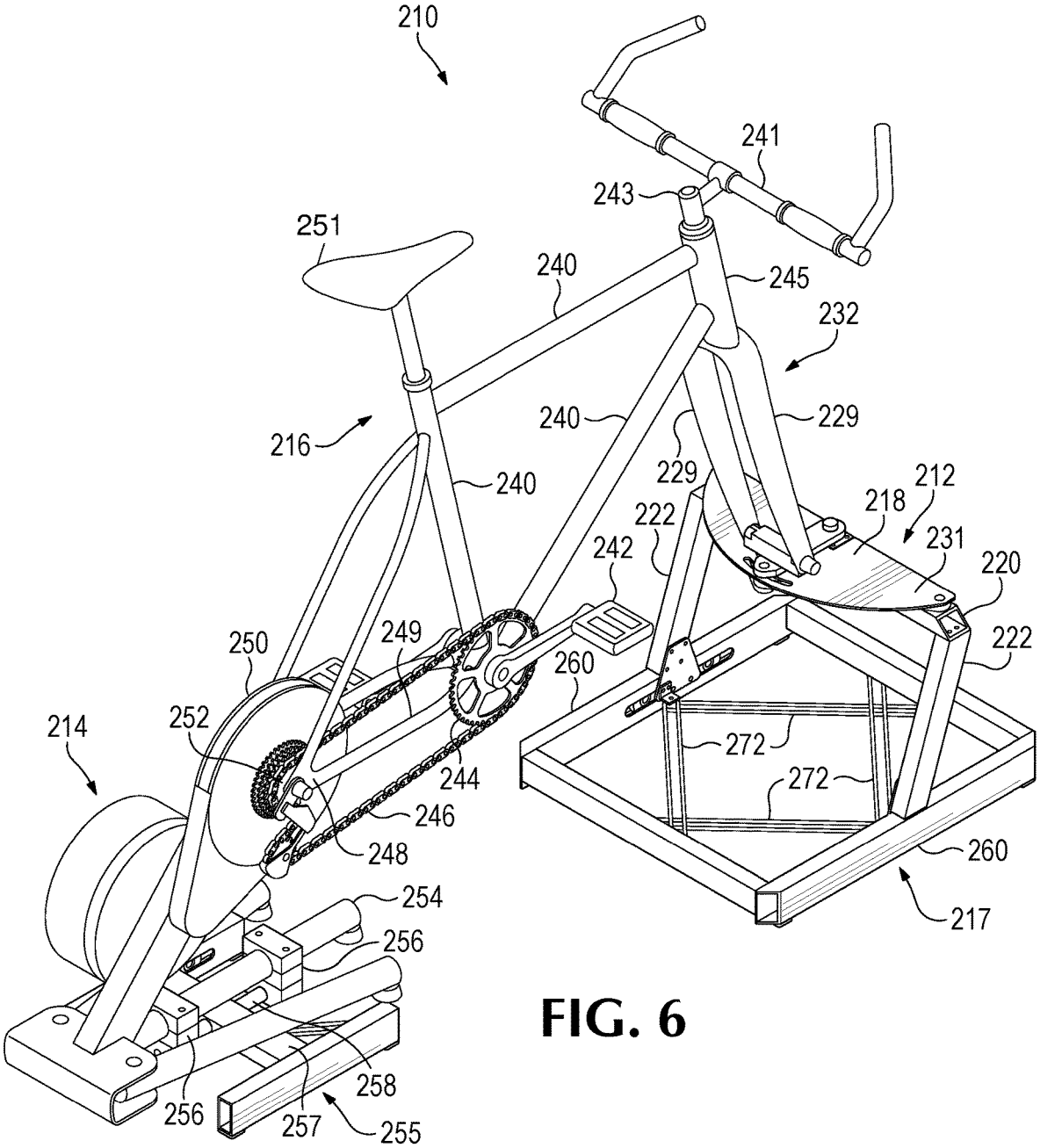
FIG. 6 is an isometric view of a bicycle trainer according to an alternative embodiment of the present invention.
Figure 7:
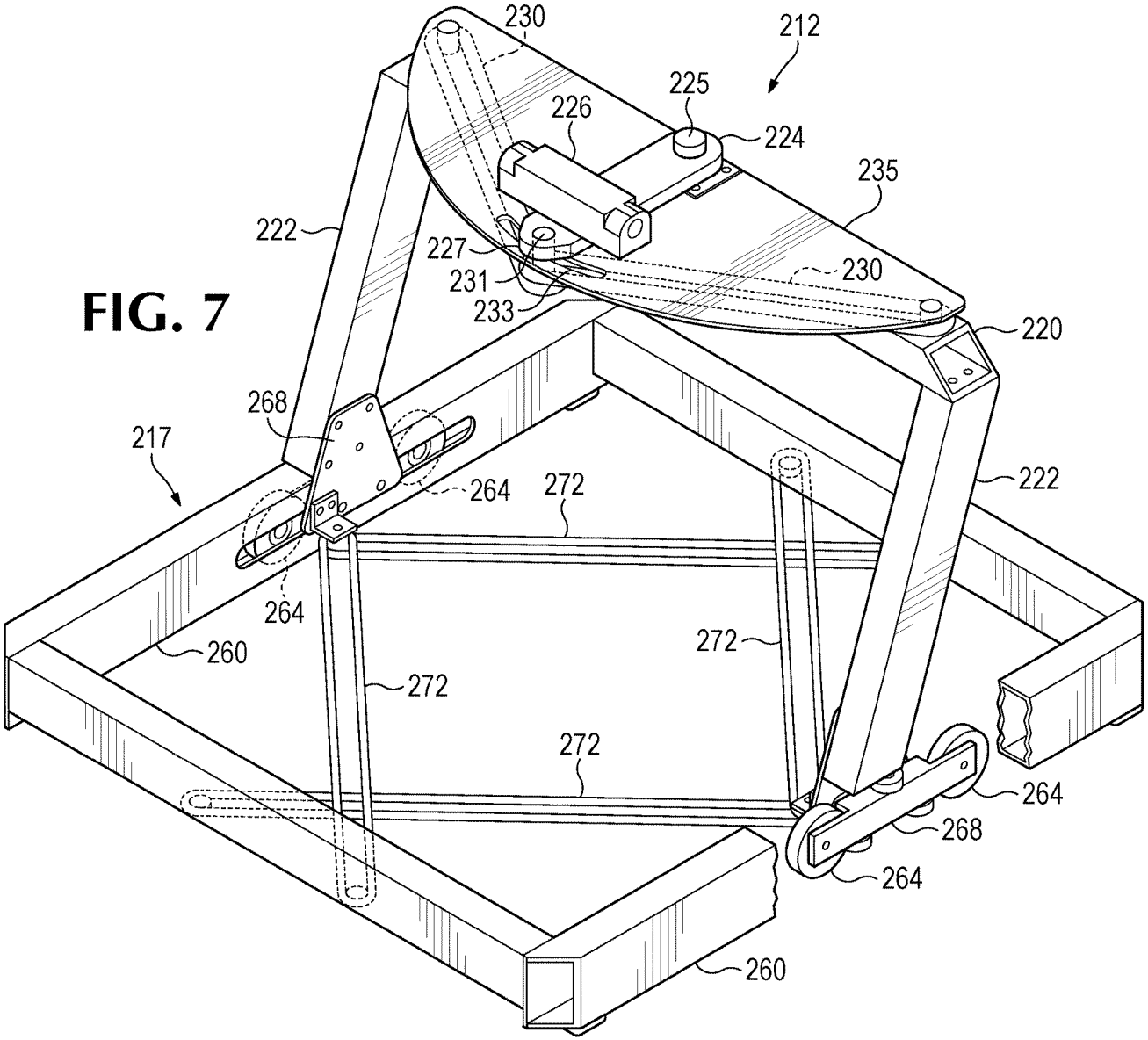
FIG. 7 is an isometric and cut-away view of the front portion of the bicycle trainer of FIG. 6.
Figure 9:
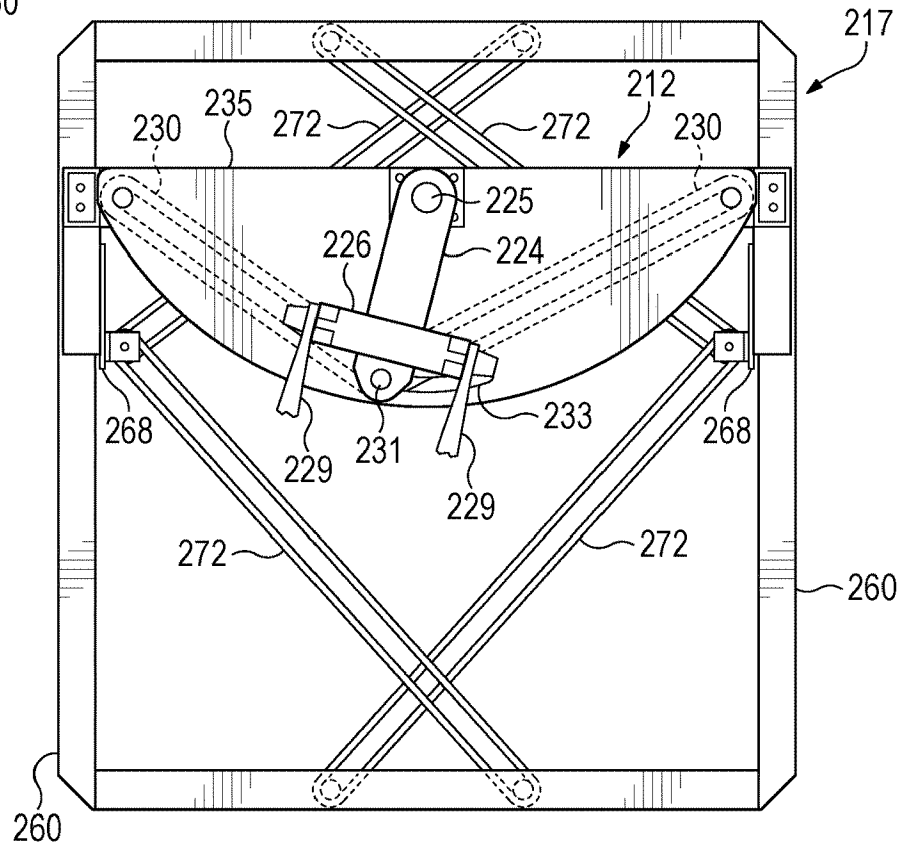
FIG. 9 is a top of the portion of FIG. 6, with the front fork support turned.

Referring now to FIG. 6, a bicycle training assembly 210 comprises a front support assembly 212, a rear support assembly 214 and a bicycle portion 216 connecting assemblies 212 and 214. Similar to embodiment 10, the front support assembly 212, includes a base 217, that includes a U-frame (also known as the handlebar support holding strut) 218, having a center bar 220 and two side supports 222. At the center of the center bar 220 is a front fork support element 224 that is rotatably mounted at a pivot or hinge point 225. Support element 224 includes a rear projection 227 that includes a support 226 for each of the arms 229 of a front wheel fork (handlebar support) 232. A post 231 extends from rear projection 227, through a slot 233 in a plate 235, which helps support projection 227. A pair of springs, in the form of rubber bands, 230, one in either sideways direction, are each mounted between post 231, and a side support 222. These rubber bands 230 provide resistance to (while permitting) side-to-side turning of support element 224, as shown in FIG. 9. As support element 224 rotates, the fork of the attached bicycle rotates, translates laterally, and tilts laterally, thereby mimicking the feel of a bicycle's response to the side-to-side weight shifting of a cyclist on a road.

Bicycle portion 216 includes a bicycle (or upper) frame 240, a handlebar 241 connected to the front wheel fork 232, by a post 243 that extends through a handlebar mount 245. Also, a pair of pedals 242 is rotatably mounted in a pedals mount (blocked from view in FIG. 6, but familiar to bicyclists) and drive a front sprocket 244, which drives a bicycle chain 246. A rear wheel mount 248 permits the frame 240 to accept a bicycle wheel or to be mounted to a device designed to mimic the feel of cycling. A pedals mount support 249, in the form of a mostly horizontal bar, supports the pedals mount from the rear wheel mount 248. A seat 251 is supported by a post engaged to frame 240. In this embodiment frame 240, handlebar 241 and seat 251 form a rider support assembly Supporting bicycle portion 216 at its rear wheel mount 248 is the rear support assembly 214, having a rear wheel mount support assembly (also termed a pedal mount support bearing member, for its bearing of pedal mount support 249) 250, which in one embodiment is a Wahoo Kickr®, which may be purchased from Wahoo Fitness LLC, a Georgia LLC, which maintains a website having web address www.wahoofitness.com. FIG. 6 shows a simplified version of the Wahoo Kickr, which in full includes a set of different sized sprockets. The user engages the bicycle chain 246 to a sprocket and moves it from one to the other with the bicycle derailleur (not shown). In the embodiment shown there is just one sprocket 252, which is engaged to chain 246. The Wahoo Kickr® includes a fly wheel to mimic the momentum of a bicycle on the road, and a magnetic brake assembly, to mimic road and wind resistance. The Wahoo Kickr®, has a central horizontal leg 254 that is retained in a rear base 255, by a pair of yolks 256, that are in turn mounted on an axle 258, so as to permit rotation, thereby permitting rear mount support assembly 250 to roll from side-to-side, as the user tilts portion 216 by turning handle bar 241. In one embodiment this rotation is gently resisted by elastomeric members. A base cross-member 257 supports axle 258.

Base 255 and base 217, collectively form a lower base sub-assembly, that supports the handlebar support holding strut 218 and the rear wheel mount (pedal mount support bearing member) 248. In this embodiment the lower base sub-assembly includes a front unit and a rear unit, but in an alternative embodiment, it includes a single unit only.

Figure 8:
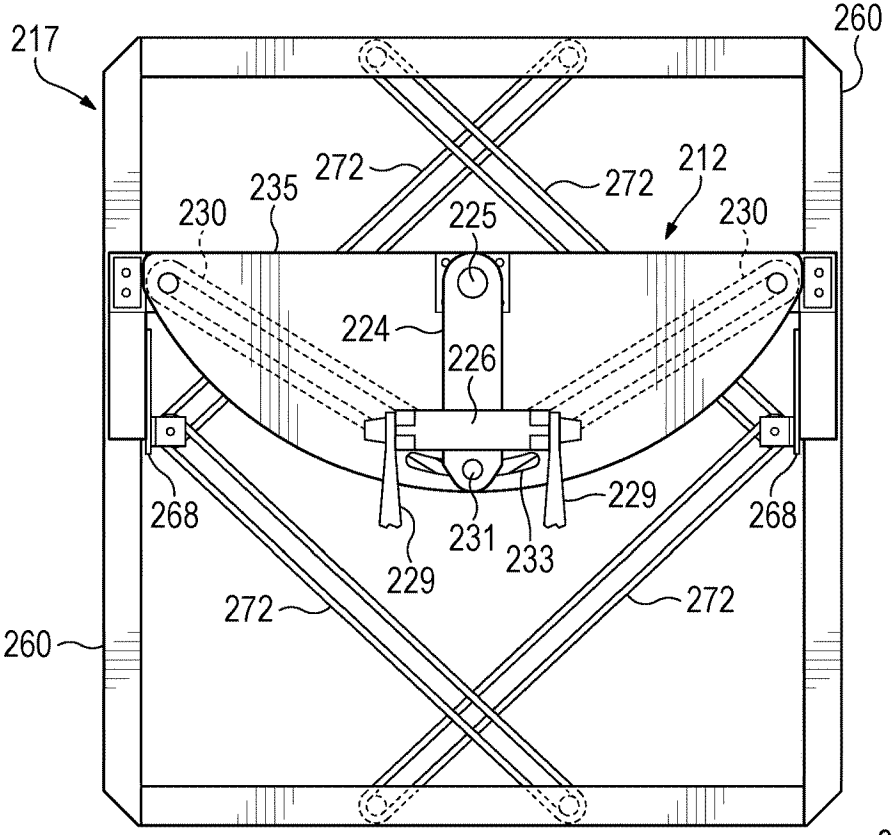
FIG. 8 is a top view of the portion of FIG. 6, with the front fork support centered.
Figure 10:
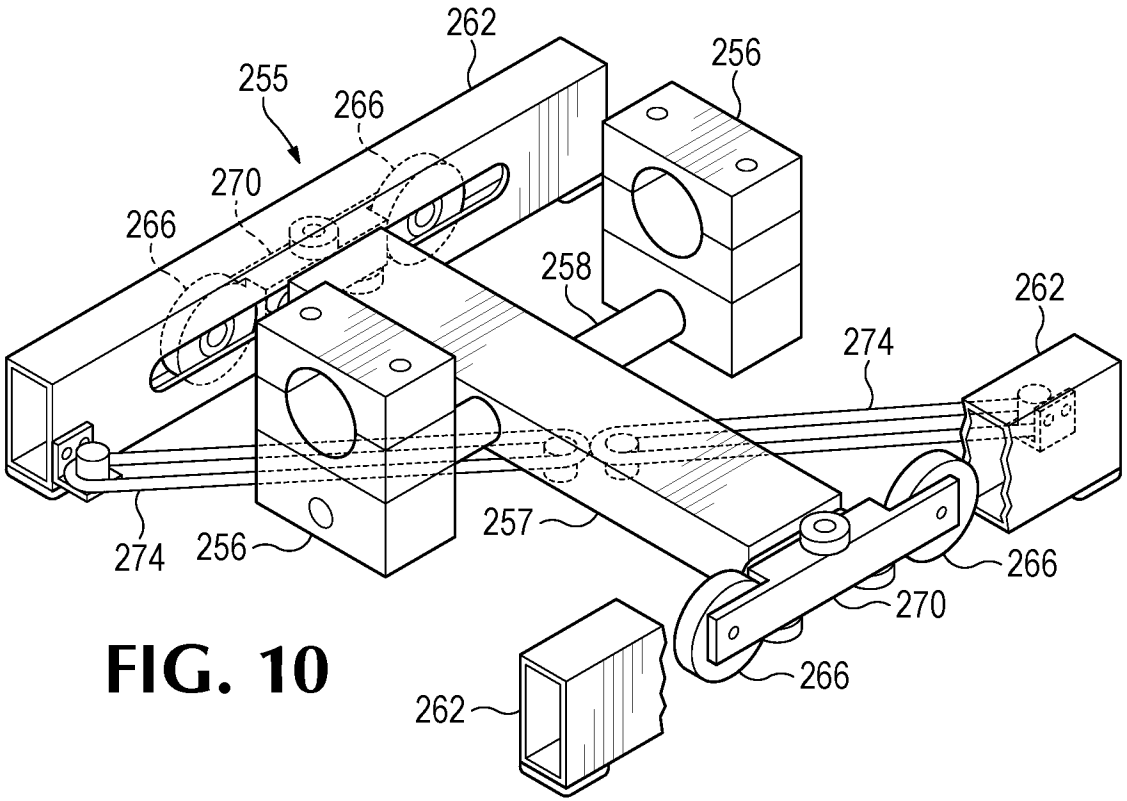
FIG. 10 is an isometric and cut-away view of the rear portion of the bicycle trainer of FIG. 6.
Figure 12:
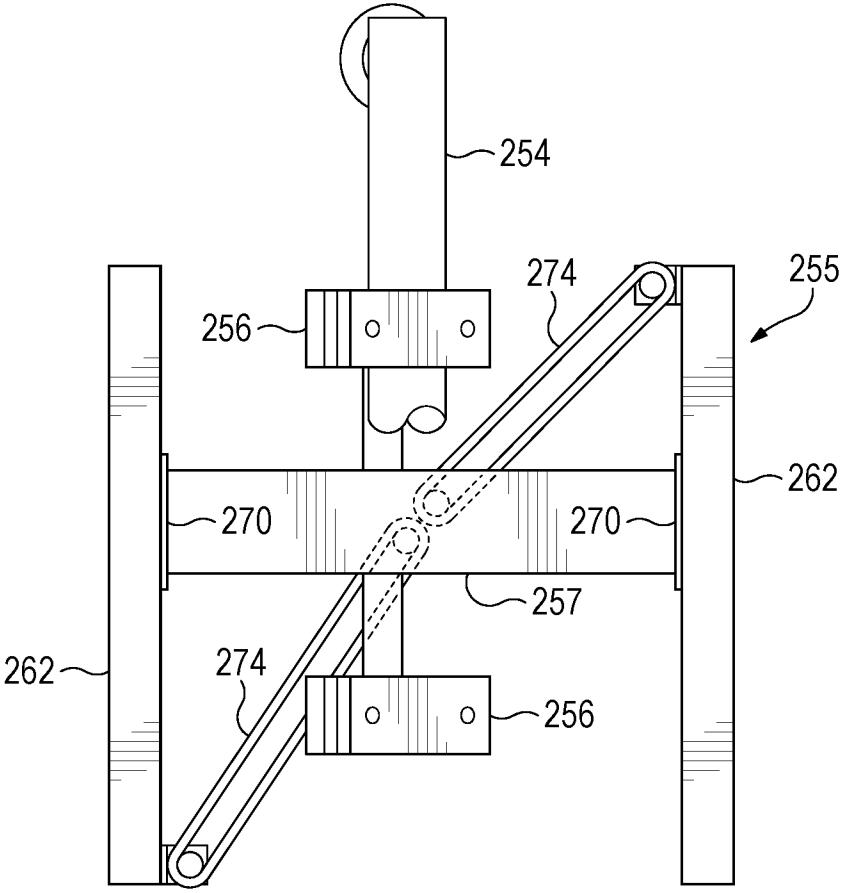
FIG. 12 is a top view of the portion of FIG. 10, with the rear support turned.
Figure 11:
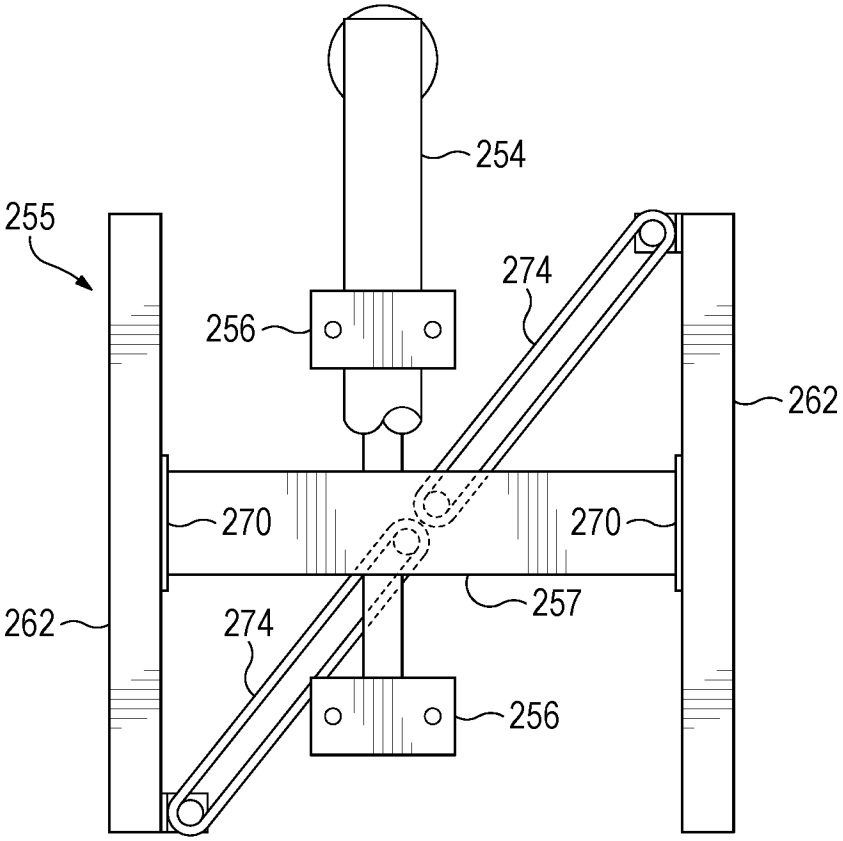
FIG. 11 is a top view of the portion of FIG. 10, with the rear support centered.

Referring to FIGS. 6-12, front support assembly 212 and rear support assembly 214 permit fore and aft movement of bicycle portion 216, by including a pair of front tracks 260 and rear tracks 262, front rollers 264 and rear rollers 266, and front carriages 268 and rear carriages 270, riding on rollers 264 and 266 respectively. A set of front rubber bands 272 and rear rubber bands 274 gently resist the fore and aft motion. Referring to FIGS. 8 and 9, FIG. 8 shows the front support assembly 212 with the carriage in an "at rest" position where rubber bands 272 are evenly tensioned. In FIG. 9, carriage 268 has moved forward relative to its position in FIG. 8, and the handlebar 241 has turned slightly to the left, thereby turning rear projection 227 to the left. Referring to FIGS. 11 and 12, FIG. 11 shows the carriage 270, and therefore cross beam 257 in a centered location, whereas FIG. 12 shows rear support assembly 214, as it would be if the front support assembly 212 was in the position of FIG. 9, with cross member 257 pulled forward slightly. Accordingly, the rearmost of elastic bands 274 is stretched and yolks 256 are rotated slightly to the right, as they would be if the handlebar 241 was turned slightly to the left as in FIG. 9.

The effect is a particularly realistic mimicry of the feel of actual bicycle riding, with the fore and aft movement mimicking the effects of inertia that cyclists feel, and the ability to steer the bicycle portion and to feel this portion lean as the rider turns the handle bar, provides a far more accurate feel of actual bicycle steering, than previously available trainers.

Figure 13:
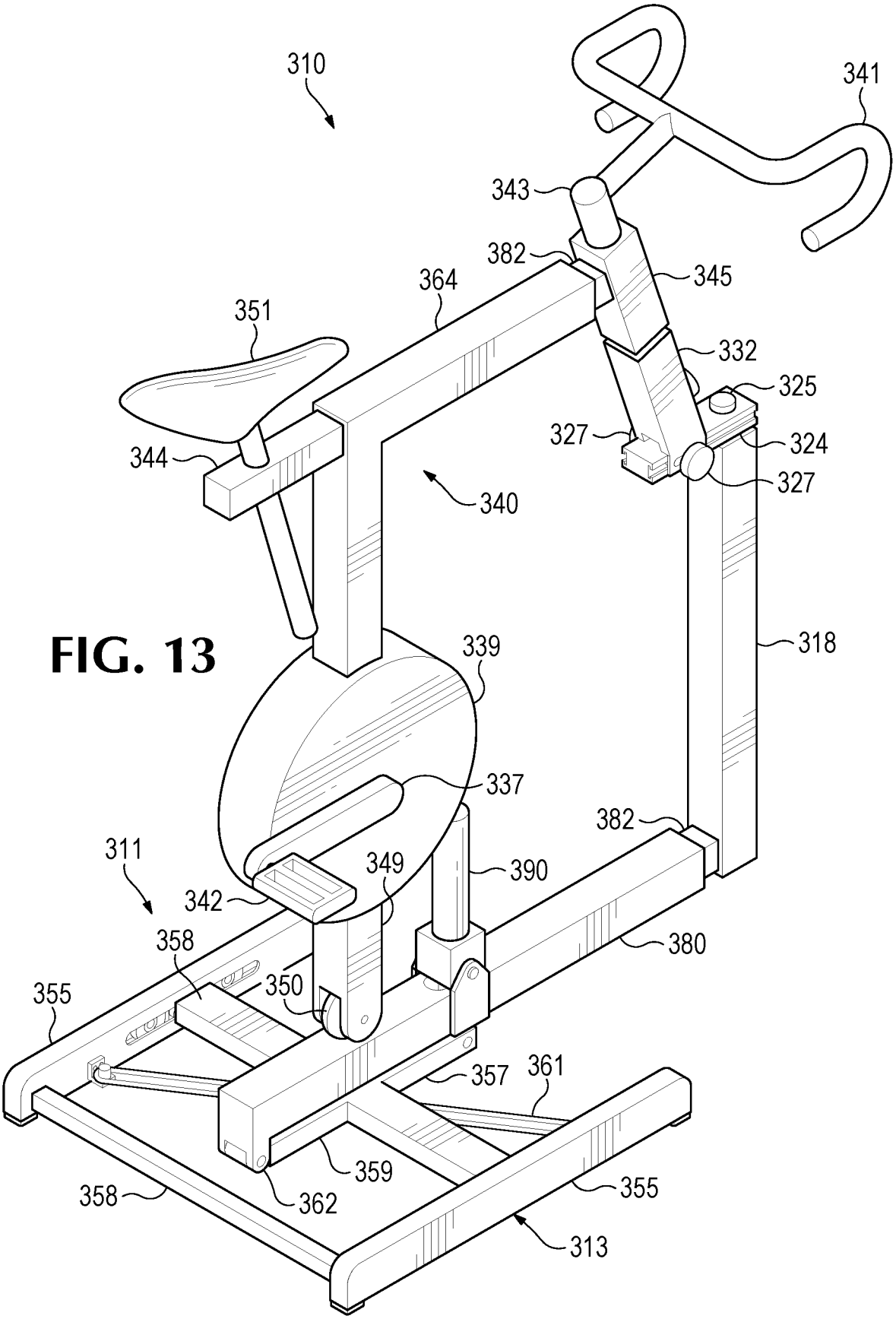
FIG. 13 is a top-rear isometric view of a bicycle trainer according to a further alternative embodiment of the present invention.
Figure 15:
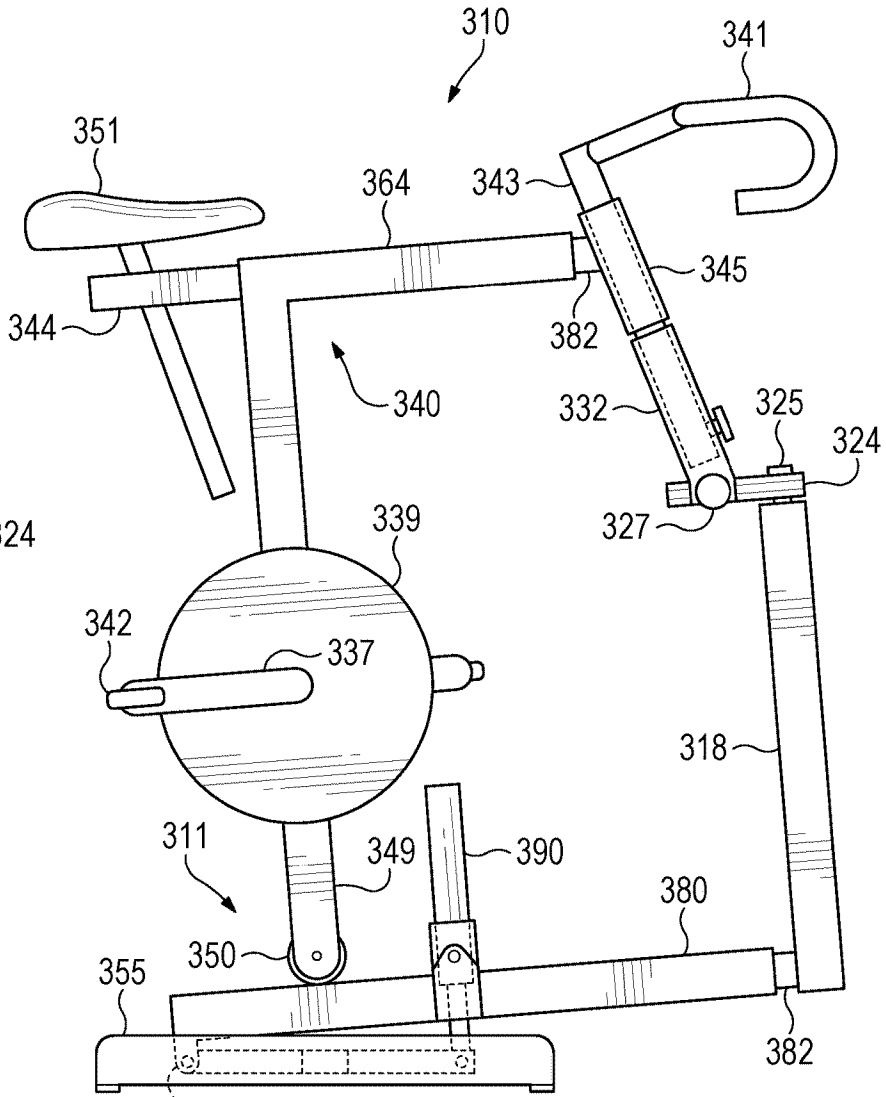
FIG. 15 is a side view of the bicycle trainer of FIG. 13, in a second state, in which the upper frame is tilted upward.
Figure 14:
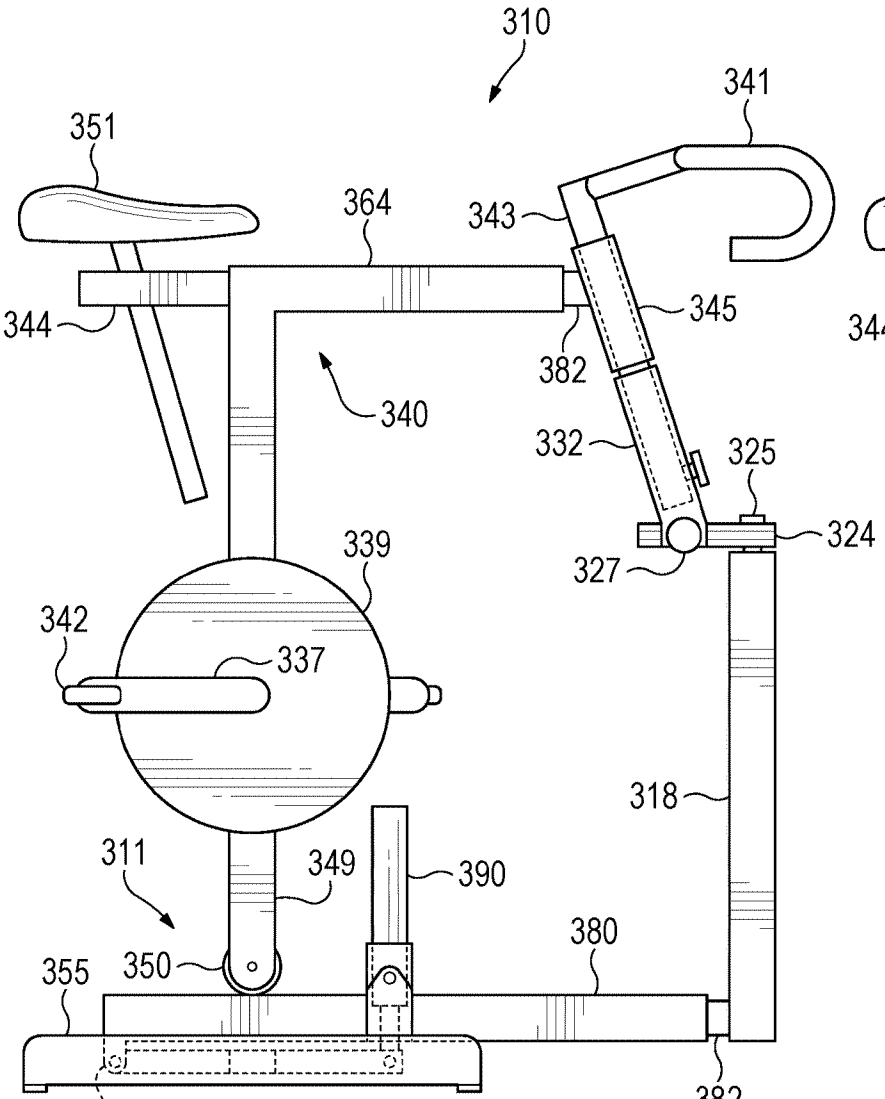
FIG. 14 is a side view of the bicycle trainer of FIG. 13, in a first state, in which the upper frame is not tilted upward.

Referring now to FIGS. 13, 14 and 15, in an alternative preferred embodiment of a bicycle training assembly 310, the lower base subassembly 311 is made of a single unit, base unit 313. This unit 313 includes a pair of spaced apart feet 355 adapted to rest on a floor, and a slider 357, including a slider crossbeam 358 that is mounted in sliding engagement with each of feet 355, which are also joined by crossbeam 358. A hinge 362 connects a lengthwise support beam 380, at its rear, to the back end of slider lengthwise part 359. A rubber band 361, gently resists the fore and aft movement of slider 357. Sliding engagement can be achieved by using a set of rollers or wheels mounted inside spaced apart feet 355. In one embodiment a longitudinal element of slider 357 is interposed between upper and lower rollers in either foot 355.

At its frontmost end, beam 380 supports a handlebar support holding strut 318. Strut 318 in turn supports a tongue 324, that is horizontally rotatably engaged to strut 318 at hinge 325, and which at a user selectable location, supports handlebar support 332, joined to post 343, which supports handlebar 341. Post 343 is rotatably mounted in a handlebar mount 345. A pair of threaded knobs 327 can be loosened to change the position where support 332 meets tongue 324, and then tightened to retain the two elements in place. The effect of this design, is that a rider can rotate the handlebar 341 in a first direction, and this will cause the seat 351 and the pedals 342 to move in the opposite direction, just as happens when a bicycle rider is riding an actual bicycle, or the trainer embodiments of FIGS. 1-12.

As tongue 324 rotates, post 343 rotates, translates laterally, and tilts laterally, as happens naturally as a bicycle rider pedals a bicycle and shifts his weight from side to side. Although the cyclic motion is subtle for a rider pedaling softly and sitting down, it becomes more noticeable for a rider who is standing and pedaling with greater force. The more accurate motion mimicry of the embodiments 110, 210 and 310 disclosed herein causes the user to cycle with a set of motions, and muscle actions, far more similar to those of a bicycle rider traveling on a road than is the case for a user of a prior art trainer. The user experience feels more like bicycle riding and prepares the user's musculature, muscle memory and reaction habits for actual bicycle riding far more effectively than the user experience of prior art trainers.

A pedal mount support bearing member 350, is pivotably supported by an upwardly facing surface of slider 357, which is part of lower base subassembly 311. Pedal mount support 349, supported by member 350, in turn support a pedals' mount 337, in turn rotatably supporting pedals 342 and including a round housing 339, that in turn supports an upper frame 340. Frame 340 supports a seat mount 344, which in turn supports a seat 351. Round housing 339 further includes a pedaling resistance assembly (not shown) that can be controlled by a rider, to have increased or decreased resistance. Frame 340 includes a joining bar 364, joining the handlebar mount 345 to the seat mount 344 and providing strength and stability for assembly 310. Both the lengthwise support beam 380 and the joining bar 364, include a telescoping member 382, permitting length adjustment for accommodating different size riders.

A fluid pressure cylinder 390 is mounted to support beam 380 and contacts lengthwise part 359 of slider 357 through a hole in beam 380, thereby permitting cylinder 390 to rotate beam 380 about its hinge with lengthwise part 359, raising up the front portion of beam 380, together with the handlebar 341, relative to seat 351. Although controls for fluid pressure cylinder 390 and pedaling resistance assembly are not shown, skilled persons will understand that a wide variety of wired and wireless controls are possible, and that a computer can control pedaling resistance and tilt from cylinder 390 to mimic the effects of riding a bicycle through different types of terrain.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A bicycle training assembly having a rear and a front, comprising:

(a) an upper frame, including a seat mount, a handlebar mount, a pedals mount; a seat support extending from said seat mount to said pedals mount, and a joining bar, joining said handlebar mount to said seat mount; a pedals mount support extending from said pedals mount;

(b) a handlebar unit, including a handlebar supported by a post that is rotatably engaged to said handlebar mount, a further handlebar support extending downwardly from said post;

(c) a seat unit, including a seat supported by a seat post that is engaged to said seat mount;

(d) a pair of pedals rotatably mounted in said pedals mount;

(e) a base assembly, including:

(i) a handlebar support holding strut;

(ii) a pedal mount support bearing member;

(iii) a lower base subassembly adapted to rest on a flat upward surface and including a base unit set, supporting said handlebar support holding strut and a pedal mount support bearing member, and permitting fore and aft movement;

(f) a pedaling resistance assembly;

(g) wherein a front fork support element is hinged to said handlebar support holding strut, so as to permit substantially horizontal rotation and said handlebar support is supported by said front fork support element;

(h) wherein said pedals mount support bearing member is pivotably supported atop said lower base sub-assembly, and (i) wherein, when said handlebar is turned to a side, said handlebar support rotates and said upper frame rotates about said point where said pedals mount support bearing member is pivotably supported atop said lower base sub-assembly.

2. The bicycle training assembly of claim 1, wherein said base unit set includes a single unit only, including a single slide base frame to which a slider is slidingly engaged so as to permit fore and aft movement, said slider supporting both said handlebar support holding strut and said pedals mount support bearing member.

3. The bicycle training assembly of claim 1, wherein said pedals resistance mechanism is housed together with said pedals mount.

4. The bicycle training assembly of claim 1, wherein said upper frame is set at a vertical cant angle, and further including a compressed fluid cylinder, adjustable to change said vertical cant angle of said upper frame.

5. The bicycle training assembly of claim 1, wherein said pedals mount support is vertical, thereby having a bottom, and said pedals mount support bearing member is a wheel, mounted at said bottom of said pedals mount support, and resting on a flat upward surface of said slider.

6. The bicycle training assembly of claim 5, wherein said slider includes a lengthwise support beam, supporting said handlebar support holding strut and joining it to said flat upward surface upon which said pedals mount support bearing member rests.

7. The bicycle training assembly of claim 6, wherein said joining bar and said lengthwise support beam are both telescoping length adjustable bars.

8. The bicycle training assembly of claim 1, wherein said unit set includes a front unit, having a front unit slide base frame to which a front slider is slidingly engaged so as to permit fore and aft movement and a rear unit, having a rear unit slide base frame to which a rear slider is slidingly engaged so as to permit fore and aft movement, said front slider supporting said handlebar support holding strut and said rear slider supporting said pedal mount support bearing member.

9. The bicycle training assembly of claim 8, wherein said upper frame, said handlebar unit, said seat unit and said pair of pedals are all portions of a bicycle, from which front and rear wheels have been removed, said bicycle further including a front cog wheel set driven by said pedals, a chain engaged to said front cog wheel set, a rear derailleur, and a rear wheel mount that supports said pedal mount support, which is substantially horizontal, and further wherein said rear wheel mount is supported by a bicycle trainer acting as said pedal mount support bearing member, said bicycle trainer including a cog wheel set to which said chain is engaged and further being pivotably engaged to said rear slider.

10. A bicycle trainer, comprising:

(a) a base, includes a front unit, having a front unit slide base frame to which a front slider is slidingly engaged so as to permit fore and aft movement, during use;

(b) a bike frame, supported by said base;

(c) a seat and a handlebar assembly and a pedaling assembly, supported by said frame;

(d) wherein said handlebar assembly is rotatably engaged to said frame, and is supported by a front fork support element, that is hinged to said front slider so as to permit horizontal rotation; and (e) wherein turning said handlebars causes said frame to move laterally.

11. The bicycle trainer of claim 10, wherein said pedaling assembly, permits user selectable resistance to peddle movement.

12. The bicycle trainer of claim 10, wherein said pedaling assembly includes rotatably mounted pedals and a fly wheel to mimic the momentum of a bicycle traveling on a road.

13. The bicycle trainer of claim 10, wherein said frame, seat, and handlebar assembly are all portions of an actual bicycle from which the front wheel has been removed from the wheel fork, and the rear wheel has been removed from the rear wheel mount.

14. The bicycle trainer of claim 13, wherein said pedaling assembly includes the pedals, front sprocket and derailleur of the actual bicycle, and a rear wheel mount trainer, attached at said rear wheel mount.

15. The bicycle trainer of claim 14, wherein said base is dived into two separate physical units, said front unit supporting said tongue, and a rear unit supporting said rear wheel mount.

16. The bicycle trainer of claim 10, wherein said pedaling assembly includes a flywheel turned directly by said pedals.

17. The bicycle trainer of claim 10, said fore and aft movement permitted by said base, is gently resisted.

18. A bicycle trainer, having a rear and a front defining a longitudinal dimension and a transverse dimension, and comprising:

(a) a base, adapted to rest on a flat upward surface and having two parallel feet extending substantially in said longitudinal dimension and set apart longitudinally;

(b) a slider, having a transverse portion, transversely spanning said base and being slidably engaged to each foot, to permit fore and aft movement, and having a longitudinal section extending from the transverse center of said transverse portion, said longitudinal section having a front and a back;

(c) a base support beam, vertically hinged to said back of said longitudinal section;

(d) an upper frame, including a seat mount, a handlebar mount, a pedals mount; a seat support extending from said seat mount to said pedals mount, and a joining bar, joining said handlebar mount to said seat mount; a pedals mount support extending from said pedals mount;

(e) a handlebar unit, including a handlebar supported by a post that is rotatably engaged to said handlebar mount, a further handlebar support extending downwardly from said post;

(f) a seat unit, including a seat supported by a seat post that is engaged to said seat mount;

(g) a pair of pedals rotatably mounted in said pedals mount;

(h) a pedals support mount bearing member, supporting said pedals mount support and being pivotably supported by said base support beam;

(i) a handlebar support holding strut, being supported by said front of said base support beam, (j) wherein a front fork support element is hinged to said handlebar support holding strut, so as to permit substantially horizontal rotation and said handlebar support is supported by front fork support element;

(k) wherein, when said handlebar is turned to a side, said handlebar support translates as well as rotates and said upper frame rotates about said point where said pedals mount support bearing member is pivotably supported by said lower base sub-assembly, and (l) further including a fluid pressure cylinder, mounted on said longitudinal section of said slider and attached to said base support beam, as to raise said base support beam upwardly causing to rotate vertically about said back of said longitudinal section, where it is hinged.

* * * * *